US008133583B2

(12) United States Patent
Tian et al.

(10) Patent No.: US 8,133,583 B2
(45) Date of Patent: Mar. 13, 2012

(54) FIRE RETARDANT ANTIFLUX FIBER AND ITS PRODUCTION PROCESS

(75) Inventors: Sufeng Tian, Shandong (CN); Lejun Wang, Shandong (CN)

(73) Assignee: Shandong Helon Co., Ltd., Weifang, Shandong (CN)

( * ) Notice: Subject to any disclaimer, the term of this patent is extended or adjusted under 35 U.S.C. 154(b) by 297 days.

(21) Appl. No.: 12/521,299

(22) PCT Filed: Mar. 5, 2007

(86) PCT No.: PCT/CN2007/000689

§ 371 (c)(1),
(2), (4) Date: Jun. 25, 2009

(87) PCT Pub. No.: WO2008/080270

PCT Pub. Date: Jul. 10, 2008

(65) Prior Publication Data

US 2010/0019213 A1 Jan. 28, 2010

(30) Foreign Application Priority Data

Dec. 28, 2006 (CN) ..... 2006 1 0170997

(51) Int. Cl.

| | |
|---|---|
| ***D01F 21/08*** | (2006.01) |
| ***D01F 21/10*** | (2006.01) |
| ***D01F 21/12*** | (2006.01) |
| ***D01F 21/00*** | (2006.01) |
| ***C09K 21/02*** | (2006.01) |
| ***C09K 21/14*** | (2006.01) |
| ***D21D 9/00*** | (2006.01) |
| ***D21D 1/00*** | (2006.01) |

(52) U.S. Cl. ..... 428/364; 428/366; 428/393; 428/404; 252/607; 252/608; 252/8.86; 162/56

(58) Field of Classification Search ..... 252/607, 252/608, 8.86; 162/56; 428/364, 366, 373, 428/374, 379, 391, 392, 393, 394, 402, 404
See application file for complete search history.

(56) References Cited

U.S. PATENT DOCUMENTS

| | | | | |
|---|---|---|---|---|
| 5,417,752 | A * | 5/1995 | Paren et al. | 106/166.82 |
| 5,601,909 | A * | 2/1997 | Kubo | 442/417 |
| 5,787,525 | A * | 8/1998 | Sugihara et al. | 5/421 |
| 5,863,653 | A * | 1/1999 | Sugihara et al. | 428/372 |
| 6,034,520 | A * | 3/2000 | Sugihara et al. | 324/71.1 |
| 6,316,102 | B1 * | 11/2001 | Sasaki | 428/364 |

FOREIGN PATENT DOCUMENTS

| | | |
|---|---|---|
| CN | 1098149 | 2/1995 |
| CN | 1401831 | 3/2003 |
| CN | 1635019 | 7/2005 |
| CN | 1847476 | 10/2006 |
| DE | 299383 | 4/1992 |
| JP | 20033105625 | 4/2003 |

OTHER PUBLICATIONS

International Search Report for International Patent Application No. PCT/CN2007/000689, dated Sep. 20, 2007.

* cited by examiner

*Primary Examiner* — Joseph D Anthony
(74) *Attorney, Agent, or Firm* — Patterson & Sheridan, L.L.P.

(57) ABSTRACT

The present invention provides a fire retardant antiflux fiber, the fiber is composed of the following components: cellulose 60~80% by mass, silicon fire retardant (calculated as silicon dioxide) 15~36% by mass, tourmaline 0.1~5%. The present invention also provides a process of producing fire retardant antiflux fiber, in the adding step, the silicon fire retardant is added into the cellulose xanthate in the xanthation step or the viscose which was prepared after the xanthation step, the level of adding the silicon fire retardant is 19~30%, calculated as silicon dioxide. The fire retardant antiflux fiber of the present invention has high fire retardant antiflux effect, high fiber strength and excellent negative ion generating efficacy. At the same time, the viscose also maintains excellent filtering performance in the procedure using above production process, reducing the production standstill caused by the viscose blocking up filter screen, improving production efficiency. The viscose fiber can be used to fabricate nonwoven fabric widely.

7 Claims, No Drawings

FIRE RETARDANT ANTIFLUX FIBER AND ITS PRODUCTION PROCESS

TECHNICAL FIELD

The present invention relates to a fire retardant antiflux fiber and its production process, which belongs to the field of fiber technology.

BACKGROUND ART

Among man-made fibers, cellulose fiber is widely used for a long history. Due to wide sources of raw materials, excellent moisture absorption, air permeability, wearing comfortableness, good dyeability and ecological relevance, cellulose fiber occupies a stable position in the production and application of man-made fibers. However, because it is easy to catch fire and has bad fire retardance, ordinary cellulose fibers can not meet the requirements of social development, thereby limiting its application ability.

With the development of society, people demand high requirements of security. In vehicles, public buildings, homes and offices, the fireproof question is attracting people's great attention. In order to reduce the fire risk induced by fabrics, various countries have developed fire-retardant standards and regulations for the application of a variety of textiles which limit the non-fire-retardant fabrics in accordance with the types and applying locations. Therefore, the fire-retardant fiber has been rapidly developed. However, until now there remain many deficiencies for the fire-retardant antiflux fibers as follows: The fire retardants used in such fibers are organic compounds and expensive; the products made up from fire retardant antiflux fibers have shortcomings such as high cost, high toxicity and pollution that are difficult to be overcome. More advanced representative products made up from fire retardant antiflux fibers are as follows: Lenzing fire retardant antiflux fiber manufactured by Austria (Lenzing) and Taihua fire retardant antiflux fiber, whose retardants are organic phosphorus or halogen compounds.

There are two main methods of producing fire-retardant fiber. One is the adding method (blending method) conducted by adding fire retardants into the spinning liquid before spinning, and obtaining the fibers with fire retardance. The other is the coating method conducted by coating the surface of fiber with diantimony trioxide and halogen-containing fire retardants that are in the form of latex, generally after the production of fibers or in the production process (fibers in the gel state). Typical fire retardants include PVC latex, polyvinyl bromide emulsions, binders made from chlorinated paraffins or brominated aromatics combined with antimony oxide.

At present, research-focused and industrially manufactured fire retardant antiflux fibers are mainly produced by the method of adding fire retardants.

The main types of fire retardants with adding are shown in table 1.

TABLE 1

| fire-retardant elements | compounds | remark |
|---|---|---|
| Phosphorus | alkyl and aryl phosphate, phosphonates, poly phosphonate, ExoLit 5060 | can produce a synergistic effect by mixing with halide |
| Phosphorus, nitrogen | phosphazene, phosphoryl or sulpho carbonyl phosphamide, spirocyclic triphosphazene, THPC-amide condensate | high efficiency, toxic when using a lot |

TABLE 1-continued

| fire-retardant elements | compounds | remark |
|---|---|---|
| Phosphorus, halogen | halogenated alkyl or aryl phosphonate or poly phosphonate, halogenated phosphite or phosphazene | The dosage can be the largest and most of them are toxic |
| silicon | silicate, polysilicate | non-toxic completely and environment-friendly |

In China, a lot of enterprises, research institutes and universities focused on research and development of flame-retardant fiber around 1990 and thus formed an upsurge of it. SandofLamefire5060 type of fire retardants were used widely, but due to high prices of importing fire retardants and low quality of domestic fire retardants that can not meet the requirements of spinning, the industrial production was not carried out in the end.

SUMMARY OF THE INVENTION

The object of the present invention is to provide a fire retardant antiflux fiber which has fire retardant antiflux effect, strong fiber strength and excellent negative ion generating efficacy.

The other object of the present invention is to provide a process of producing the fire retardant antiflux fiber. The fire retardant antiflux fiber according to the present invention has good fire retardant antiflux effect, strong fiber strength and excellent negative ion generating efficacy. At the same time, the viscose also maintains excellent filtering property during production procedure, which reduces the production standstill caused by the viscose's blocking up filter screen, and improves production efficiency.

To solve the above-mentioned problems, the present invention provides such a technical solution as follows:

The fire retardant antiflux fiber is composed of the following components: cellulose 60%~80% by mass, silicon fire retardant (calculated as silicon dioxide) 15%~36% by mass, tourmaline 0.1%~5% by mass.

The fire retardant antiflux fiber of the present invention has such properties as follows:

dry breaking strength: >1.7 cN/dtex, wet breaking strength: >0.9 cN/dtex, dry breaking elongation: >15%, deviation rate of linear density: ±7%, whiteness: >75%, limiting oxygen index>30%.

The production process of the present invention includes the following steps:

using cellulose pulp as raw material, the producing steps include impregnating, squeezing, crushing, ageing, xanthation, filtering, ripening, spinning, scouring and drying; the said scouring step includes cleaning, dehydration and oiling, it also includes a adding step of fire retardants and tourmaline, the said adding step is to add silicon fire retardant and tourmaline into the cellulose xanthate described in the xanthation step, after stirring, the mixture fully dissolves and mixes to produce a viscose; or silicon fire retardant and tourmaline are added into the viscose produced after xanthation step using static mixer or dynamic mixer; the level of adding the said silicon silicon fire retardant is 19-60% of cellulose, calculated as silicon dioxide; the level of adding the said tourmaline is 0.0015-0.85% of cellulose.

The said cellulose pulp is made from one or more materials selected from cotton linter, wood, bamboo, bagasse or reed.

The said adding step of fire retardants further includes a step of producing the solution of silicon fire retardants before adding, which includes adding silicon fire retardants into water at 5~100° C., stirring and grinding to dissolve, and then the solution is adjusted to 1-40° C.

In the spinning step, the composition of coagulation bath is as follows: sulfuric acid 60-140 grams/liter, sodium sulfate 0-350 g/l, zinc sulfate 8-60 g/l, aluminum sulfate 0-40 grams/liter; the temperature of coagulation bath is at the range of 20° C.-65° C.

As an improvement, a cross-linking processing step is conducted after the said cleaning step and before dehydration and oiling; the cross-linking agents used in the said cross-linking processing step are sodium aluminate powder or liquid, which will be formulated to 2-10 g/l solution and heated to 70-90° C., cross-linking time is 3-10 minutes.

The steps that are not particularly specified in the present invention such as impregnation, squeezing, crushing, ageing, xanthation, filtering, ripening, spinning, scouring and drying can be carried out in accordance with commonly used technologies and equipments in the art.

Since the above technical solution is adopted and the present invention makes use of cellulose pulp as material, the fiber mainly comprising cellulose can be produced, when burning, can be only carbonized instead of melted. Tourmaline in the viscose fiber endows the viscose fiber with negative ion generating efficacy, thus making it capable of refreshing air, improving the environment and preventing diseases.

Since the silicon fire retardant is added into the spinning solution, the retardant in molecular state after dissolution is mixed with the molecules of cellulose, thus it ensures viscose's filtering property after the fire retardant is added. Further, in the filtering step, it generally doesn't lead to blocking up filter screen, thus it ensures the smooth production.

At the same time, when viscose is forming in acid bath in the spinning step, the cellulose forms a macromolecular chain structure. Micelles in the process of silicate act as a "nucleus" role in promoting the supersaturated silicic acid molecules to precipitate from solution. And the rest of silicic acids generate polyorthosilicic acid which exists in the molecules of cellulose in the colloidal state of reticular silicon. Fiber is firmly bound to fire retardant through molecular bond, which make strength and elongation of cellulose and other physical index significantly better than other fire-retardant fibers produced by adding the fire retardant.

Through cross-linking treatment, molecules of fire retardant react between each other and form reticular macromolecules, which ensures the fiber resistant to alkali, improves the color and hand feeling of the fiber, so that the strength of recycled fiber is increased to some extent. The viscose fiber can be widely used in the manufacture of non-woven, etc.

MODE OF CARRYING OUT THE INVENTION

The present invention will be further illustrated with reference to the examples as follows, but the scope of the present invention is not limited thereto.

EXAMPLE 1

1.67 dtex*38 mm Fire Retardant Antiflux Fiber

Using cellulose pulp (made from cotton linter) as raw material, alkali cellulose was produced by the steps of impregnating two times (first, impregnating at 50° C. with a concentration of 240 g/l; Second, impregnating at 49° C. with a concentration of 176 g/l), squeezing, crushing (crushing degree is 200 seconds) and ageing (cuprammonia viscosity of ageing outlet was 60 mPa s), the content of alpha cellulose, that is α cellulose, was 30% in the alkali cellulose.

20 Kg of $Na_2SiO_3.9H_2O$ containing 21 percent of $SiO_2$ and 0.02 Kg of tourmaline were added to 60 L of xanthated dissolved water. After stirring and grinding at 18° C. for dissolving, adjusting the temperature to 30° C., the obtained solution was added to xanthate resulting from 40 Kg alkali cellulose. The said tourmaline, with its chemical formula $Na(Mg,Fe,Li,Al)_3Al_6[Si_6O_{18}](BO_3)_3(OH,F)_4$, consists of cyclic structure silicate characterized by containing B. The spinning viscose was obtained after making it fully dissolved by stirring and mixing. 1.67 dtex*38 mm staple fiber was produced by spinning in coagulation acid bath with sulfuric acid content of 110 g/l, sodium sulfate content of 330 g/l, zinc sulfate content of 10 g/l, the temperature of 48° C., and stretching appropriately. After acid washing and water washing, the resulting neutral fiber was cross linked for 5 minutes in the cross-linking bath containing 8 g/l of sodium metaaluminate ($Na_2AL_2O_4$) at 80° C. The 1.67 dtex*38 mm fire retardant antiflux fiber was obtained after dehydration, oiling and drying.

Fiber indicators: dry breaking strength: 2.13 cN/dtex; wet breaking strength: 1.12 cN/dtex; dry breaking elongation: 20.4%; deviation rate of linear density: −1.2%; whiteness: 79%; oil content: 0.18%; moisture regain: 12.1%; limiting oxygen index (LOI) 30.5%.

EXAMPLE 2

3.33 dtex*60 mm Fire Retardant Antiflux Fiber

Using cellulose pulp (made from wood pulp) as raw material, alkali cellulose was produced by impregnating two times (first, impregnating at 49° C. with a concentration of 240 g/l; Second, impregnating at 49° C. with a concentration of 177 g/l), squeezing, crushing (crushing degree is 210 seconds) and ageing (cuprammonia viscosity of ageing outlet was 58 mPa s), the content of alpha cellulose, that is α cellulose, was 30% in the alkali cellulose.

10 Kg of $K_2SiO_3$ containing 49 percent of $SiO_2$ and 0.05 Kg of tourmaline were added to 60 L of xanthated dissolved water. After stirring and grinding at 5° C. for dissolving, adjusting the temperature to 1° C., the obtained solution was added to xanthate resulting from 60 Kg alkali cellulose. The spinning viscose was obtained after making it fully dissolved by stirring and mixing. 3.33 dtex*60 mm staple fiber was produced by spinning in the coagulation acid bath with sulfuric acid content of 85 g/l, sodium sulfate content of 320 g/l, zinc sulfate content of 15 g/l, the temperature of 40° C., and stretching appropriately. After acid washing and water washing, the resulting neutral fiber was cross linked for 6 minutes in the cross-linking bath containing 7 g/l of sodium metaaluminate ($Na_2AL_2O_4$) at 82° C. The 3.33 dtex*60 mm fire retardant antiflux fiber was obtained after dehydration, oiling and drying.

Fiber indicators: dry breaking strength: 2.03 cN/dtex; wet breaking strength: 1.01 cN/dtex; dry breaking elongation: 21.0%; deviation rate of linear density: −2.8%; whiteness: 78%; oil content: 0.19%; moisture regain: 11.4%; limiting oxygen index (LOI) 38%.

EXAMPLE 3

3.33 dtex*60 mm Fire Retardant Antiflux Fiber

Using cellulose pulp (cotton linter pulp: bagasse pulp: reed pulp is equal to 8:1:1) as raw material, alkali cellulose was produced by impregnating two times (first, impregnating at 49° C. with a concentration of 240 g/l; Second, impregnating at 49° C. with a concentration of 177 g/l), squeezing, crushing (crushing degree is 210 seconds) and ageing (cuprammonia viscosity of ageing outlet was 55 mPa s), the content of alpha cellulose, that is a cellulose, was 30% in the alkali cellulose.

10 Kg of $K_2SiO_3$ containing 49 percent of $SiO_2$ and 0.05 Kg of tourmaline were added to 60 L of xanthated dissolved water. After stirring and grinding at 90° C. for dissolving, adjusting the temperature to 35° C., the obtained solution was added to xanthate resulting from 60 Kg alkali cellulose. The spinning viscose was obtained after making it fully dissolved by stirring and mixing. 3.33 dtex*60 mm staple fiber was produced by spinning in the coagulation acid bath with sulfuric acid content of 60 g/l, sodium sulfate content of 200 g/l, zinc sulfate content of 60 g/l, the temperature of 65° C., and stretching appropriately. After acid washing and water washing, the resulting neutral fiber was cross linked for 10 minutes in the cross-linking bath containing 2 g/l of sodium metaaluminate ($Na_2AL_2O_4$) at 90° C. The 3.33 dtex*60 mm fire retardant antiflux fiber was obtained after dehydration, oiling and drying. Fiber indicators: dry breaking strength: 2.07 cN/dtex; wet breaking strength: 0.98 cN/dtex; dry breaking elongation: 19%; deviation rate of linear density: −2.8%; whiteness: 80%; oil content: 0.18%; moisture regain: 11.2%; limiting oxygen index (LOI) 34%.

EXAMPLE 4

2.78 dtex*51 mm Fire Retardant Antiflux Fiber

Using cellulose pulp (cotton linter pulp: wood pulp is equal to 7:3) as raw material, alkali cellulose was produced by impregnating two times (first, impregnating at 50° C. with a concentration of 240 g/l; Second, impregnating at 49° C. with a concentration of 176 g/l), squeezing, crushing (crushing degree is 200 seconds) and ageing (cuprammonia viscosity of ageing outlet was 53 mPa s), the content of alpha cellulose, that is α cellulose, was 30% in the alkali cellulose.

A spinning viscose was produced by using a static mixer to add the solution prepared by 20 Kg of $Na_2SiO_3.9H_2O$ containing 21 percent of $SiO_2$ and 0.03 Kg of tourmaline to the viscose resulting from 60 Kg of alkali cellulose. 2.78 dtex*51 mm staple fiber was produced by spinning in the coagulation acid bath with sulfuric acid content of 120 g/l, sodium sulfate content of 330 g/l, aluminum sulfate content of 6 g/l, the temperature of 48° C., and stretching appropriately. After water washing, the resulting neutral fiber was cross linked for 6 minutes in the cross-linking bath containing 7 g/l of sodium metaaluminate ($Na_2AL_2O_4$) at 82° C. The 2.78 dtex*51 mm fire retardant antiflux fiber was obtained after dehydrating, oiling and drying.

Fiber indicators: dry breaking strength: 2.11 cN/dtex; wet breaking strength: 1.08 cN/dtex; dry breaking elongation: 19.4%; deviation rate of linear density: −0.8%; whiteness: 78%; oil content: 0.18%; moisture regain: 11.1%; limiting oxygen index (LOI) 33.5%.

EXAMPLE 5

3.88 dtex*80 mm Fire Retardant Antiflux Fiber

Using cellulose pulp (cotton linter pulp: wood pulp: bamboo pulp is equal to 7:2:1) as raw material, alkali cellulose was produced by impregnating two times (first, impregnating at 50° C. with a concentration of 240 g/l; Second, impregnating at 49° C. with a concentration of 176 g/l), squeezing, crushing (crushing degree is 200 seconds) and ageing (cuprammonia viscosity of ageing outlet was 53 mPa s), the content of alpha cellulose, that is a cellulose, was 30% in the alkali cellulose.

A spinning viscose was produced by using a dynamic mixer to add the solution prepared by 30 Kg of $K_2SiO_3.9H_2O$ containing 21 percent of $SiO_2$ and 0.06 Kg of tourmaline to the viscose resulting from 46 Kg of alkali cellulose. 3.88 dtex*80 mm fiber was produced by spinning in the coagulation acid bath with sulfuric acid content of 120 g/l, sodium sulfate content of 330 g/l, zinc sulfate content of 16 g/l, the temperature of 48° C., and stretching appropriately. After water washing, the resulting neutral fiber was cross linked for 5 minutes in the cross-linking bath containing 8 g/l of sodium metaaluminate ($Na_2AL_2O_4$) at 80° C. The 3.88 dtex*80 mm fire retardant antiflux fiber was obtained after dehydrating, oiling and drying.

Fiber indicators: dry breaking strength: 2.11 cN/dtex; wet breaking strength: 1.08 cN/dtex; dry breaking elongation: 19.4%; deviation rate of linear density: −0.8%; whiteness: 78%; oil content: 0.18%; moisture regain: 11.11%; limiting oxygen index (LOI) 31.5%.

INDUSTRIAL APPLICABILITY

The fire retardant antiflux fiber of the present invention has good fire retardant antiflux effect, strong fiber strength and excellent negative ion generating efficacy. At the same time, during the process of producing fire retardant antiflux fiber, in the adding step, the silicon fire retardant is added into the cellulose xanthate in the xanthation step or the viscose which was prepared after the xanthation step, which makes the viscose maintain excellent filtering performance, reducing the production standstill caused by the viscose's blocking up filter screen and improving production efficiency. The fire retardant antiflux fiber can be used to manufacture nonwoven fabric widely.

What is claimed is:

1. A fire retardant antiflux fiber, characterized in that it is composed of the following components: cellulose 60%~80% by mass, silicon fire retardant (calculated as silicon dioxide) 15%~36% by mass, tourmaline 0.1%~5% by mass; the silicon fire retardant is selected from the group consisting of sodium silicate, potassium silicate or their mixture;

the antiflux fiber has such indicators as follows:

dry breaking strength: >1.7 cN/dtex, wet breaking strength: >0.9 cN/dtex, dry breaking elongation: >15%, deviation rate of linear density: 7%, whiteness: >75%, limiting oxygen index >30%.

2. The fire retardant antiflux fiber according to claim 1, characterized in that, the said tourmaline, with its chemical formula $Na(Mg,Fe,Li,Al)_3Al_6[Si_6O_{18}](BO_3)_3(OH,F)_4$, consists of cyclic structure silicate characterized by containing Boron.

3. The fire retardant antiflux fiber according to claim 1, characterized in that, said cellulose is one or more selected from the group consisting of cotton linter, wood, bamboo, bagasse and reed.

4. A process of producing the said fire retardant antiflux fiber in claim 1, using cellulose pulp as raw material, comprising: impregnation, squeezing, crushing, ageing, xanthation, filtering, ripening, spinning, scouring and drying; the said scouring step comprising cleaning, dehydration and oiling, characterized in that the process further includes a step to add retardants and tourmaline, the said adding step is to add silicon fire retardant and tourmaline into the cellulose xanthate in the xanthation step, after stirring, the mixture fully dissolves and is mixed to produce a viscose; or using static mixer or dynamic mixer to add silicon fire retardant and tourmaline into the viscose produced after xanthation step; in the spinning step, the coagulation bath comprises: sulfuric acid 60-140 grams/liter, sodium sulfate 0-350 g/l, zinc sulfate 8-60 g/l, aluminum sulfate 0-40 grams/liter; the temperature of coagulation bath is at the range of 20° C-65° C.

5. The process of producing the fire retardant antiflux fiber according to claim 4, characterized in that, said cellulose pulp is made from one or more materials selected from the group consisting of cotton linter, wood, bamboo, bagasse and reed.

6. The process of producing the fire retardant antiflux fiber according to claim 4, characterized in that, the step adding fire retardants further includes a step producing the solution of silicon fire retardants before adding, which includes adding silicon fire retardants into water at 5~100° C., stirring and grinding to dissolve, and then the solution is adjusted to 1-40° C.

7. The process of producing the fire retardant antiflux fiber according to claim 4, characterized in that, a cross-linking processing step is conducted after said cleaning step and before dehydration and oiling; the cross-linking agents used in said cross-linking processing step are sodium aluminate powder or liquid, which is formulated to 2-10 g/l solution and heated to 70-90° C., cross-linking time is 3-10 minutes.

* * * * *